US006202755B1

(12) United States Patent
Hardge

(10) Patent No.: US 6,202,755 B1
(45) Date of Patent: Mar. 20, 2001

(54) FIRE EXTINGUISHING AGENT AND METHOD OF PREPARATION AND USE THEREOF

(75) Inventor: Lawrence J. Hardge, Los Angeles, CA (US)

(73) Assignee: Fidelity Holdings Inc., Kew Gardens, NY (US)

( * ) Notice: Subject to any disclaimer, the term of this patent is extended or adjusted under 35 U.S.C. 154(b) by 0 days.

(21) Appl. No.: 09/325,231

(22) Filed: Jun. 3, 1999

(51) Int. Cl.[7] ..... A62C 13/62
(52) U.S. Cl. ..... 169/71; 169/46; 169/54
(58) Field of Search ..... 169/30, 43, 46–50, 169/54, 70, 71

(56) References Cited

U.S. PATENT DOCUMENTS

| | | | | |
|---|---|---|---|---|
| 3,033,291 | * | 5/1962 | Wieslander | 169/30 |
| 3,074,883 | * | 1/1963 | Letterson | 169/47 X |
| 3,172,607 | | 3/1965 | Riuli et al. | 239/288 |
| 3,609,074 | | 9/1971 | Rainaldi | 252/3 |
| 3,976,580 | * | 8/1976 | Kaminstein et al. | 169/47 X |
| 4,014,799 | | 3/1977 | Owens | 252/8 |
| 4,226,728 | | 10/1980 | Kung | 252/8 |
| 4,668,407 | | 5/1987 | Gerard et al. | 252/8 |
| 4,826,610 | | 5/1989 | Thacker et al. | 252/8 |
| 4,897,207 | | 1/1990 | Greene | 252/2 |
| 5,135,054 | | 8/1992 | Nimitz et al. | 169/46 |
| 5,219,474 | | 6/1993 | Song et al. | 252/8 |
| 5,466,386 | | 11/1995 | Stewart et al. | 252/2 |
| 5,698,630 | | 12/1997 | Andersson | 252/8 |
| 5,833,874 | | 11/1998 | Stewart et al. | 252/8 |
| 5,845,716 | * | 12/1998 | Birk | 169/71 X |
| 5,862,867 | * | 1/1999 | Andersson | 169/71 |

* cited by examiner

*Primary Examiner*—Lesley D. Morris
(74) *Attorney, Agent, or Firm*—David P. Gordon; David S Jacobson; Thomas A Gallagher

(57) ABSTRACT

A fire extinguishing agent includes an oxygen depleting agent, a heat removing endothermic agent, and a flame retarding agent. According to a preferred embodiment of the invention, the oxygen depleting agent is preferably a halon gas mixture of equal parts Halon 1211 and Halon 1301, the endothermic agent is preferably carbon dioxide, and the flame retarding agent preferably includes an aqueous solution of baking soda and a standard liquid flame retardant. The fire extinguishing agent, which may be provided in gas, liquid, or powder form, is preferably pressurized with nitrogen or another inert gas. According to a preferred aspect of the invention, the Halon 1211 and Halon 1301 are forced through a diesel fuel filter prior to entering the pressurized container. The filter removes and collects reactive chlorofluorocarbon constituents from the halon gases. The fire extinguishing agent extinguishes a fire, removes heat from the fire and material which was burning, and retards reignition of the fire. In addition, the removal of reactive chlorofluorocarbon constituents permits the extinguishing agent to be relatively environmentally friendly. The halon gases extinguish the flames by removing oxygen from the fire, the carbon dioxide removes heat from the fire, and the flame retardant agent provides a coating which prevents oxygen from interacting with the fire.

32 Claims, 1 Drawing Sheet

FIRE EXTINGUISHING AGENT AND METHOD OF PREPARATION AND USE THEREOF

BACKGROUND OF THE INVENTION

1. Field of the Invention

This invention relates broadly to an agent usable as an extinguishant, a method of preparing the fire extinguishing agent, and several uses of the fire extinguishing agent.

2. State of the Art

It is well known that halogenated hydrocarbons, or halons, are very effective fire extinguishing agents. Halon 1301 ($CF_3Br$) has been in widespread use for "total flood" applications; that is, applications in which the agent is stored and discharged into occupied spaces such as computer facilities and restaurant kitchens, often by an automatic discharge or sprinkler system. Halon 1211 ($CF_2ClBr$) has slightly greater toxicity but, due to its effectiveness, is extensively used for hand-held tank and outdoor mobile "streaming" applications, particularly for jet fuel fires. Halon 1211 and Halon 1301 have also been mixed together to provide a multipurpose extinguishing agent.

The halons operate as fire extinguishants by a complex chemical reaction involving the disruption of free-radical chain reactions to effectively remove oxygen from the fire and extinguish a fire. In addition, the halons are clean as well as effective, because they leave no residue and because they do not damage equipment or facilities to which they are applied.

However, the halons have several limitations. First, it has been determined that the halons have an ozone depleting effect. The halons break down into chlorofluorocarbon components which react with and thereby remove ozone from the atmosphere. Therefore, there has recently been a push away from halons and toward finding alternatives which are as effective. However, although a large amount of research has been conducted to find a replacement, none of the candidates has proven to be as effective as halons, and at the same time harmless to the environment.

Second, due to the complex chemical reaction which occurs during extinguishment, the halons operate best in either a closed space, where there is a contained oxygen supply, or in very close proximity to the fire. They are not as effective in outdoor use where the oxygen supply surrounding the fire is abundant, particularly when sprayed from large distances toward a fire. Therefore, they are not particularly effective in extinguishing fires when sprayed at a distance from the flames.

Third, even the halons do not provide as effective an extinguishment as desired. For example, while the halons extinguish the flames of a fire, they do not permit timely re-entry of a previously burning building or timely handling of a previously burning object due to the remaining heat. Moreover, the halons do not prevent reignition of a fire at the location of a previously extinguished fire.

SUMMARY OF THE INVENTION

It is therefore an object of the invention to provide a fire extinguishing agent which is more effective than using either Halon 1211 and Halon 1301.

It is another object of the invention to provide a fire extinguishing agent which extinguishes a fire, removes heat from a fire, and retards reignition of the fire.

It is a further object of the invention to provide a fire extinguishing agent which is relatively safe for the environment.

It is an additional object of the invention to provide a fire extinguishing agent which can be used indoors or outdoors.

It is also an object of the invention to provide a fire extinguishing agent has relatively low toxicity.

It is still another object of the invention to provide a fire extinguishing agent which may be used in a great number of applications.

In accord with these objects, which will be discussed in detail below, a preferred fire extinguishing agent includes an oxygen depleting agent, a heat removing (endothermic) agent, and a flame retarding agent. According to a preferred embodiment of the invention, the oxygen depleting agent is preferably a halon gas mixture of equal parts Halon 1211 and Halon 1301, the endothermic agent is preferably carbon dioxide, and the flame retarding agent preferably includes an aqueous solution of baking soda (potassium chloride), a liquid flame retardant, or a combination thereof. The fire extinguishing agent, which may be provided in gas, liquid, or powder form, is preferably pressurized with nitrogen or another inert gas. More particularly, the agent preferably comprises forty percent halon gas mixture of equal parts Halon 1211 and Halon 1301, twenty percent carbon dioxide, and forty percent flame retarding agent consisting essentially of a liquid flame retardant and small amount of the aqueous solution of baking soda.

The fire extinguishing agent extinguishes a fire, removes heat from the fire and material which was burning, and retards reignition of the fire. As a result, the area of an extinguished fire may be occupied immediately subsequent to use of the fire extinguishing agent. In addition, the agent is suitable for both indoors and outdoor use, and effectively extinguishes a fire even when streaming flames from a distance.

According to a preferred aspect of the invention, the components of the agent are provided under pressure of the pressurant gas into an aqueous solution in a container, e.g., a fire extinguisher tank. According to a preferred aspect of the invention, the Halon 1211 and Halon 1301 are forced through a filter, and preferably a diesel fuel filter, prior to entering the pressurized container. The filter removes and collects reactive chlorofluorocarbon constituents from the halon gases. As a result, the fire extinguishing agent, upon dispersion from the container into a fire, is relatively more environmentally friendly than prior fire extinguishing agents.

The fire extinguishing agent may be used in a variety of fire extinguishing applications. In addition to hand-held fire extinguishing tanks, which may be used in the home, computer rooms, kitchens, airplanes, etc., the fire extinguishing agent may be used in flood and streaming applications, may be used to fight forest fires, and may be used in a tanker truck, among other applications. Furthermore, the fire extinguishing agent is suitable for extinguishing A-class (solid), B-class (liquid), and C-class (electrical) fires.

Additional objects and advantages of the invention will become apparent to those skilled in the art upon reference to the detailed description taken in conjunction with the provided figures.

DETAILED DESCRIPTION OF THE PREFERRED EMBODIMENTS

The fire extinguishing agent according to the invention preferably includes an oxygen depleting agent, a heat removing (endothermic) agent, and a flame retarding agent. The oxygen depleting agent is preferably a halon gas mixture of equal parts Halon 1211 and Halon 1301 and the endothermic agent is preferably carbon dioxide. The flame retarding agent preferably includes a liquid flame retardant which retards flame spread from fabrics, woods, and cellulosic materials, and an aqueous solution of baking soda (potassium chloride). A preferred liquid flame retardant is Inspecta-Shield® sold by Louisiana Fire Extinguisher, Inc., in Baton Rouge, La.

The fire extinguishing agent is preferably provided in liquid form, but may also be provided in gas or powder form. In each form, the agent is preferably contained under pressure. A preferred pressurant is nitrogen due to its safety, low cost, and availability, but other pressurant gases may be used. In addition, in each form, the fire extinguishing agent is adapted for extinguishing A-class (solid), B-class (liquid), and C-class (electrical) fires.

Liquid Fire Extinguishant

According to a first embodiment of the invention, the agent preferably comprises forty percent halon gas mixture of equal parts Halon 1211 and Halon 1301, twenty percent carbon dioxide, and forty percent flame retarding agent. The flame retarding agent preferably includes a liquid flame retardant and small amount of the aqueous solution of baking soda. All the components of the agent are preferably in solution in water.

Figure 1:
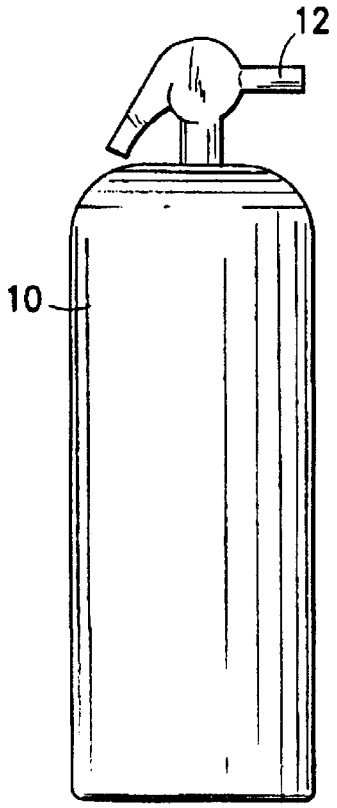
FIG. 1 is a side elevation of a fire extinguisher according to the invention.

For example, referring to FIG. 1, for a five pound extinguisher tank 10 (i.e., a tank of the size used to hold 5 lb of halon gas in the prior art), the agent comprises approximately one pound Halon 1211, approximately one pound Halon 1301, approximately one pound carbon dioxide, and approximately two pounds flame retardant comprising one-half a teaspoon of baking soda in sixteen ounces of water and the remainder being a liquid flame retardant. While another concentration of baking soda may be used, where the fire extinguishing agent is to be provided into a fire extinguisher tank 10 having a nozzled outlet 12, the baking soda should be provided in a concentration which will not clog the nozzled outlet 12. Nitrogen or other pressurant gas is provided for expelling the agent. A preferred pressure of the pressurant gas in a five pound tank is 195 psi.

According to a preferred aspect of the invention, when filling the tank 10 with the components of the extinguishing agent, the Halon 1211 and Halon 1301 are forced through a diesel fuel filter prior to entering the container. The filter removes and collects reactive chlorofluorocarbon constituents from the halon gases prior to the halon gases entering the tank. The other components of the fire extinguishing agent are preferably fed directly into the container, without passage through the filter. The resulting fire extinguishing agent, upon dispersion from the container 10 into a fire, is relatively more environmentally friendly than prior fire extinguishing agents utilizing halon gases. This is because a large percentage of the reactive chlorofluorocarbon constituents are captured by the filter, rather than released into the environment. The fuel filter may then be contained to trap the collected chlorofluorocarbon constituents and discarded in accord with accepted hazardous materials disposal procedures.

When there exists a fire which needs to be extinguished, the fire extinguisher tank, or other container in which the fire extinguishing agent is provided, can be operated to spray or stream the agent onto the fire. The components of the agent have a synergistic effect which operates to safely and rapidly extinguish the fire and retard the reignition of a fire. More particularly, the halon gases extinguish the flames by removing oxygen from the fire, the carbon dioxide removes heat from the burning material rapidly decreasing the temperature below the combustion temperature of the burning material, the liquid flame retardant prevents oxygen from interacting with the burning material, and the baking soda provides a fine flame retardant coating over the surface of the burning material which additionally prevents the surface of the burning material from interacting with oxygen. It has been found that the use of both the liquid flame retardant and the baking soda provides greater retardation than either component on its own. As a result, due to the rapid cooling, the area of an extinguished fire may be occupied immediately subsequent to use of the fire extinguishing agent. In addition, the agent is suitable for both indoor and outdoor use, and effectively extinguishes a fire even when streamed from a distance.

Gas Fire Extinguishant

According to a second embodiment of the invention, the fire extinguishing agent is provided in a gas form. The agent includes an oxygen depleting agent such as Halon 1211 and Halon 1301, preferably in a one to one ratio, a heat removing agent such as carbon dioxide, which are held at a pressure which permits them to assume a gaseous form. A flame retarding agent such as a relatively small amount of liquid flame retardant and/or baking soda may be suspended in the gas. The halon gases are provided into the tank or other storage container through a filter to remove chlorofluorocarbons, as described above. In its gas form, the fire extinguishing agent need not necessarily be propelled by a nitrogen propellant, as the halon gas and/or carbon dioxide may be provided in the concentration to provide the fire extinguishing agent at the required pressure.

Solid Fire Extinguishant

According to a third embodiment of the invention, the fire extinguishing agent is provided in a primarily solid form. In its solid form the extinguishing agent includes carbon dioxide (dry ice), baking soda, and preferably another condensed flame retarding powder, all under extremely high pressure of nitrogen. If desired, halon gas can be added, preferably filtered as above. The halon gas will be absorbed by the powder components, such that a solid-gas mixture results.

Applications

The fire extinguishing agent may be used in a variety of fire extinguishing applications. In addition to hand-held fire extinguishing tanks 10, as shown in FIG. 1, which may be used in the home, computer rooms, kitchens, factory and warehouse facilities, airplanes, cars, trucks, heavy-equipment, etc., the fire extinguishing agent may be used in flood and streaming applications, and may be used in a tanker truck, a wheeled tank unit, or even in a tank-equipped snow mobile, among other applications.

Figure 2:
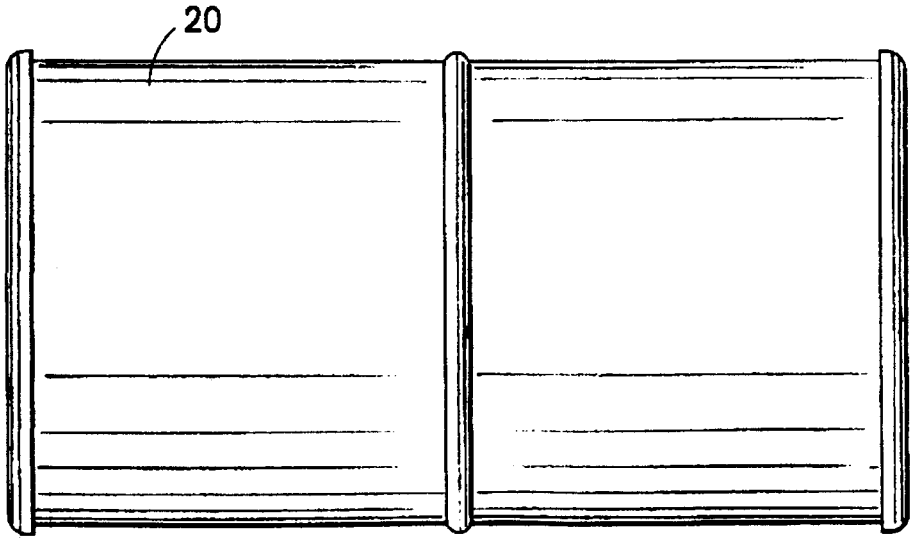
FIG. 2 is a side elevation of a break away container according to the invention.

One particular application for the fire extinguishing agent is in the fighting of forest fires. In the prior art, large volumes of water are dropped into a fire to douse the flames in an attempt to extinguish the fire. However, due to the tremendous heat in such fires, much of the water evaporates in the air prior to reaching the fire. Referring now to FIG. 2, according to the invention, a break-away container 20, e.g., a fifty-five gallon drum designed to open when impacted, is preferably provided, under pressure, with the fire extinguishing agent according to the invention. The halon gases are provided into the container through a filter as described above. In addition, it will be appreciated that because the fire extinguishing agent is not required to be expelled through a nozzle, and issues of nozzle clogging are not present, a relatively larger amount of baking soda may be used than described above. One or more of the containers can be dropped into the fire. The containers explode on impact with the forest floor (rather than evaporating at the tree canopy level, as in the case of dropped water) and the fire extinguishing agent is dispersed to remove the oxygen feeding the flames, to cool the area to a temperature substantially below the combustion temperature of wood, and to coat the trees and ground cover with a flame retarding substance to thereby inhibit reignition of the fire. If the containers are dropped at the edge of an advancing fire, they can effectively create a fire line which will contain the fire.

There have been described and illustrated herein several embodiments of a fire extinguishing agent and applications therefor. While particular embodiments of the invention have been described, it is not intended that the invention be limited thereto, as it is intended that the invention be as broad in scope as the art will allow and that the specification be read likewise. Thus, while carbon dioxide has been disclosed as a heat removing agent, it will be appreciated that other heat removing agents may be used. In addition, while a particular flame retardant has been disclosed, it will be appreciated that other flame retardants, preferably adapted for fabrics, woods, and cellulosic materials, may be used as well. Furthermore, while a preferred ratio of the extinguishant components has been disclosed, it will be understood that other component ratios can be used. Also, while a halon gas mixture is preferred, it will be recognized that a single halon gas, i.e., either Halon 1211 or Halon 1301, may be used alone. Furthermore, while a diesel fuel filter is disclosed for the removal of chlorofluorocarbon constituents, other filters capable of filtering chlorofluorocarbons may be used. Moreover, while several applications of the fire extinguishing agent have been disclosed, it will be appreciated that other applications exist, as the agent of the invention can be used for all fire classes. It will therefore be appreciated by those skilled in the art that yet other modifications could be made to the provided invention without deviating from its spirit and scope as so claimed.

What is claimed is:

1. A fire extinguishing agent, comprising:

a) an oxygen depleting agent includes a halon gas;

b) a heat removing agent; and c) a flame retarding agent.

2. A fire extinguishing agent according to claim 1, wherein:

said halon gas is at least one of $CF_3Br$ and $CF_2ClBr$.

3. A fire extinguishing agent according to claim 1, wherein:

said oxygen depleting agent includes a mixture of substantially equal parts $CF_3Br$ and $CF_2ClBr$.

4. A fire extinguishing agent according to claim 1, wherein:

said heat removing agent is carbon dioxide.

5. A fire extinguishing agent according to claim 1, wherein:

said flame retarding agent includes baking soda.

6. A fire extinguishing agent according to claim 1, wherein:

said flame retarding agent includes a liquid flame retardant.

7. A fire extinguishing agent according to claim 1, wherein:

said fire extinguishing agent is in a substantially liquid form.

8. A fire extinguishing agent according to claim 1, wherein:

said fire extinguishing agent includes a powder.

9. A fire extinguishing agent, comprising:

a) an oxygen depleting agent;

b) a heat removing agent; and c) a flame retarding agent, wherein said fire extinguishing agent comprises approximately forty percent by weight of said oxygen depleting agent, approximately forty percent by weight of said flame retarding agent, and approximately twenty percent by weight of said heat removing agent.

10. A fire extinguishing agent, comprising:

a) an oxygen depleting agent;

b) a heat removing agent; and c) a flame retarding agent, wherein said fire extinguishing agent is in a substantially gaseous form.

11. A fire extinguishing agent, comprising:

a) an endothermic agent;

b) a flame retardant; and c) at least one halon gas.

12. A fire extinguishing agent according to claim 11, wherein:

said endothermic agent is carbon dioxide.

13. A fire extinguishing agent according to claim 11, wherein:

said flame retarding agent includes baking soda.

14. A fire extinguishing agent according to claim 11, wherein:

said flame retarding agent includes a flame retardant adapted to retard flame spread on fabrics, woods, and cellulosic materials.

15. A fire extinguishing agent according to claim 11, wherein:

said fire extinguishing agent is in solid form.

16. A fire extinguishing agent according to claim 11, wherein:

said at least one halon gas includes a mixture of $CF_3Br$ and $CF_2ClBr$.

17. A fire extinguishing agent according to claim 11, wherein:

said fire extinguishing agent comprises approximately forty percent by eight of said at least one halon gas, approximately forty percent by weight of said flame retarding agent, and approximately twenty percent by weight of said endothermic agent.

18. A fire extinguishing agent according to claim 11, wherein:

said fire extinguishing agent is adapted to extinguish A-class, B-class, and C-class fires.

19. A fire extinguisher, comprising:

a) a container; and b) a fire extinguishing agent in said container, said fire extinguishing agent comprising an oxygen depleting agent including at least one halon gas, a heat removing agent, and a flame retarding agent.

20. A fire extinguisher according to claim 19, further comprising:

c) a pressurant in said container which pressurizes said fire extinguishing agent.

21. A fire extinguisher according to claim 21, wherein:

said at least one halon gas is filtered prior to being placed into said container.

22. A fire extinguisher according to claim 21, wherein:

said at least one halon gas is filtered halon gas having reactive chlorofluorocarbon constituents substantially removed.

23. A fire extinguisher according to claim 19, wherein:

said container is a break-away container.

24. A fire extinguisher according to claim 19, wherein:

said container is an extinguisher tank provided with a nozzle, and said flame retarding agent includes baking soda.

25. A method for preparing a fire extinguishing agent, comprising:

a) obtaining an oxygen depleting agent having reactive chlorofluorocarbon constituents; and b) filtering said oxygen depleting agent through a filter to remove the reactive chlorofluorocarbon constituents.

26. A method according to claim 25, wherein:

said filtering is through a diesel fuel filter.

27. A method according to claim 25, wherein:

said oxygen depleting agent is at least one halon gas.

28. A method according to claim 27, wherein:

said at least one halon gas is a mixture of $CF_3Br$ and $CF_2ClBr$.

29. A method according to claim 25, further comprising:

c) providing said filtered oxygen depleting agent into a container.

30. A method according to claim 29, further comprising:

d) obtaining a heat removing agent and providing said heat removing agent into said container.

31. A method according to claim 29, further comprising:

d) obtaining a flame retarding agent and providing said flame retarding agent into said container.

32. A method according to claim 31, further comprising:

e) obtaining a heat removing agent and providing said heat removing agent into said container.

* * * * *